US007021569B1

(12) United States Patent
Ogura et al.

(10) Patent No.: US 7,021,569 B1
(45) Date of Patent: Apr. 4, 2006

(54) FUEL INJECTION VALVE

(75) Inventors: Kiyotaka Ogura, Hitachinaka (JP); Atsushi Sekine, Hitachinaka (JP); Eiichi Kubota, Niihari-gun (JP); Masafumi Nakano, Hitachi (JP); Keiichi Uraki, Hitachinaka (JP); Noriyuki Maekawa, Niihari-gun (JP); Mizuho Yokoyama, Hitachinaka (JP); Yoshiyuki Tanabe, Hitachinaka (JP); Hiromasa Kubo, Yokohama (JP); Tooru Ishikawa, Kitaibaraki (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/763,972

(22) PCT Filed: Jan. 26, 2000

(86) PCT No.: PCT/JP00/00374

§ 371 (c)(1),
(2), (4) Date: Aug. 8, 2001

(87) PCT Pub. No.: WO01/55585

PCT Pub. Date: Aug. 2, 2001

(51) Int. Cl.
*B05B 1/30* (2006.01)
*F02M 59/00* (2006.01)
*F02M 61/10* (2006.01)

(52) U.S. Cl. ..... 239/585.4; 239/585.1; 239/585.5; 239/533.2; 239/533.11; 239/88

(58) Field of Classification Search ..... 239/585.1, 239/585.4, 585.5, 586, 88–93, 533.2, 533.11, 239/533.12, 461, 463; 251/129.15, 129.21, 251/127

See application file for complete search history.

(56) References Cited

U.S. PATENT DOCUMENTS 4,474,332 A * 10/1984 Kaska ..... 239/585.3
4,749,892 A * 6/1988 Mesenich ..... 310/19

(Continued)

FOREIGN PATENT DOCUMENTS

DE 199 32 761 A1 1/2001

(Continued)

OTHER PUBLICATIONS

European Search Report.

(Continued)

*Primary Examiner*—Davis Hwu
(74) *Attorney, Agent, or Firm*—Crowell & Moring LLP

(57) ABSTRACT

A fuel swirler positioned upstream of an injection orifice is disposed at the tip of a nozzle body in a fuel injector, in which the fixed core and the nozzle body are coupled to each other via a non-magnetic cylindrical seal ring press-fitted and welded to the outer circumference of one end on the nozzle body side of the fixed core and the inner circumference of one end of the nozzle body. The inner circumference of the fuel swirler and the inner circumference of the seal ring function serve as a guide for slidably guiding a stroke movement of the needle. The fuel swirler is held between the receiving surface of the nozzle body and the orifice plate, thus defining an annular fuel passage between the outer circumference of the fuel swirler and the inner circumference of the nozzle body, so that fuel flows into a passage groove formed at the lower end surface of the fuel swirler via the annular fuel passage. A mass movable in an axial direction independently of the needle is interposed between the return spring and the needle, and a plate spring is interposed between the mass and the needle.

19 Claims, 5 Drawing Sheets

U.S. PATENT DOCUMENTS

| | | | | |
|---|---|---|---|---|
| 5,127,156 | A * | 7/1992 | Yokoyama et al. | 29/890.143 |
| 5,190,221 | A | 3/1993 | Reiter | |
| 5,560,386 | A * | 10/1996 | Reiter et al. | 137/1 |
| 5,871,157 | A * | 2/1999 | Fukutomi et al. | 239/463 |
| 5,979,801 | A * | 11/1999 | Munezane et al. | 239/533.12 |
| 6,032,879 | A * | 3/2000 | Hamada et al. | 239/585.1 |
| 6,367,720 | B1 * | 4/2002 | Okamoto et al. | 239/585.1 |
| 6,474,572 | B1 * | 11/2002 | Tsuchiya et al. | 239/585.1 |

FOREIGN PATENT DOCUMENTS

| | | |
|---|---|---|
| JP | 56-4936 | 2/1981 |
| JP | 59-205084 | 11/1984 |
| JP | 3-505769 | 12/1991 |
| JP | 8-74699 | 3/1996 |
| JP | 9-126088 | 5/1997 |
| JP | 11-501100 | 1/1999 |
| JP | 11-294293 | 10/1999 |
| WO | WO 97/22798 | 6/1997 |

OTHER PUBLICATIONS

Japanese Office Action in corresponding application No. JP2001-555691, mailed Sep. 13, 2005.

* cited by examiner

FUEL INJECTION VALVE

BACKGROUND OF THE INVENTION

1. Technical Field

The present invention relates to an electromagnetic fuel injector (injection valve) for an internal combustion engine.

2. Background Art

There has been conventionally used an electromagnetic fuel injector which is driven in response to an electric signal output from an engine control unit in an internal combustion engine for an automobile or the like.

This type of fuel injector is configured such that an electromagnetic coil and a yoke are arranged around a hollow cylindrical fixed core. And a nozzle body containing a movable element (thereafter call "needle") with a valve element is fixed to the lower portion of the yoke, so that the needle is urged toward a valve seat by the force of a return spring.

A two-point support guide system is generally used for the needle in order to achieve the stability of a stroke movement. For example, as disclosed in Japanese Patent Laid-Open No. Hei 11-200993, in the case where the movable element is a needle valve, the tip of the needle valve is slidably guided on the inner circumference of a fuel swirler housed inside a nozzle body. And as to another point, a large-diameter portion functioning as a guide surface on a movable side is formed in the needle valve, to be thus slidably guided on the inner circumference of the nozzle body. A similar two-point support guide system is used for a needle configured by integrally coupling a ball and a rod which serve as a valve element.

In recent years, a fuel injector for directly injecting fuel into a cylinder in an internal combustion engine has been put to practical use also in a gasoline engine.

In the direct injection type of fuel injector, there has been proposed a long nozzle injector in which a nozzle body disposed under a yoke is slenderly elongated. In fixing such a long nozzle injector to a cylinder head, only the slender nozzle body occupying little space is placed on the cylinder head. And in the injector, a large-diameter body consisting of a yoke, a connector mold and the like can be provided apart from other parts and the cylinder head without any interference. Therefore, in the case where parts such as a suction valve and a intake manifold are densely disposed in the vicinity of the cylinder head, said fixing of the long nozzle injector has advantage of the high degree of fixing freedom.

In the above-described two-point support guide system for the needle, it is necessary to finish (grind) a guide hole formed at the inner circumference of the nozzle body in the case where the stroke movement of the needle is guided on the inner circumference of the nozzle body. If the nozzle body is elongated, the guide surface is deeply positioned, thereby making machining difficult. In the meanwhile, even in the case where the guide surface is formed at the inner circumference near an opening of the nozzle body, followed by finishing, the inner circumference of the nozzle body requires a high grinding accuracy, thereby increasing a fabricating cost accordingly. Consequently, cost reduction is desired.

In addition, since the valve element collides with a valve seat during a valve closing operation in the electromagnetic fuel injector, the valve is accidentally opened by a bounce of the valve element, thereby inducing a fear of so-called secondary injection. Therefore, there are various demands for the technique for preventing such secondary injection, the configuration which contributes to assembling facilitation, in particular, automatic assembling, and the like.

SUMMARY OF THE INVENTION

An object of the present invention is to provide a fuel injector which can solve problems such as cost reduction, centering accuracy (coaxial accuracy) and assembling facilitation of a fuel injector, simplicity of component parts, the degree of fixing freedom, and prevention of secondary injection.

The present invention has been proposed to attain the above-described object by way of a variety of modes. The gist of the present invention is as follows:

An electromagnetic fuel injector is basically configured such that an electromagnetic coil and a yoke are arranged around a fixed core, a nozzle body containing therein a needle with a valve element is fixed to the lower portion of the yoke, and the needle is urged toward a valve seat with application of the force of a return spring, and further, is provided with the following means:

(1) In order to achieve the cost reduction and centering accuracy (coaxial accuracy) in the two-point support guide system, a two-point support guide is composed as follow. In a fuel injector having the fuel swirler, a two-point support for slidably guiding a needle on the inner circumference of a non-magnetic cylindrical seal ring and the inner circumference of a fuel swirler during a valve stroke movement is composed by using the seal ring press-fitted and welded to the outer circumference of one end on a nozzle body side in a fixed core and the inner circumference of one end on the nozzle body side.

(2) In order to facilitate the assembling work of the fuel injector and simplify component parts, an electromagnetic coil and a yoke are inserted from above the fixed core, and thus, are disposed around the fixed core. Furthermore, the yoke is configured such that it can be coupled to the nozzle body in such a manner as to cover the outer periphery of an electromagnetic core. A terminal taking-out window for the electromagnetic coil is formed at a part of the upper portion of the yoke. The inner surface of the upper end of the yoke is pressed against the electromagnetic coil, thereby fixing the coil.

(4) Means described below are proposed to facilitate the assembling work of the fuel swirler and enhance the characteristics and responsiveness of fuel injection:

The fuel swirler is loosely fitted to the inner circumference of the nozzle body in such a manner as to be received by the receiving surface of the nozzle body. An orifice plate is press-fitted to the inner circumference in such a manner as to press the fuel swirler. Considering this from different points of view, the configuration is proposed that the fuel swirler is held between the receiving surface of the nozzle body and the orifice plate, and thus, an annular fuel passage is defined between the outer circumference of the fuel swirler and the inner circumference of the nozzle body, so that fuel flows in a passage groove formed at the lower-end of the fuel swirler via the annular fuel passage.

(5) In order to prevent any secondary injection, means described below are proposed as the composition capable of implementing a liquid damper structure for alleviating an impact occurring during a valve closing of the needle.

The inner circumference of the seal ring extending over the outer circumference of one end on the nozzle body side in the fixed core and the inner circumference of one end on the nozzle body side serves as a guide for the needle. The needle includes a hollow, cylindrical movable core. The outer circumference of the upper portion of the movable core is guided on the inner circumference of the seal ring. The fuel passage is secured between the outer circumference of the lower portion of the movable core and the inner circumference of the nozzle body. The fuel passage communicates with another fuel passage defined inside of the movable core upstream thereof via a through hole formed at the movable core.

(6) As means for preventing any collision (a bounce) of the needle against a valve seat or a stopper in order to prevent any secondary injection, there are proposed that an axially movable mass independently of the needle is interposed between the return spring and the needle, and that a plate spring is interposed between the mass and the needle.

DESCRIPTION OF THE PREFERRED EMBODIMENTS

A best mode embodying the present invention will be described in reference to a preferred embodiment shown in FIGS. 1 to 5.

Figure 1:
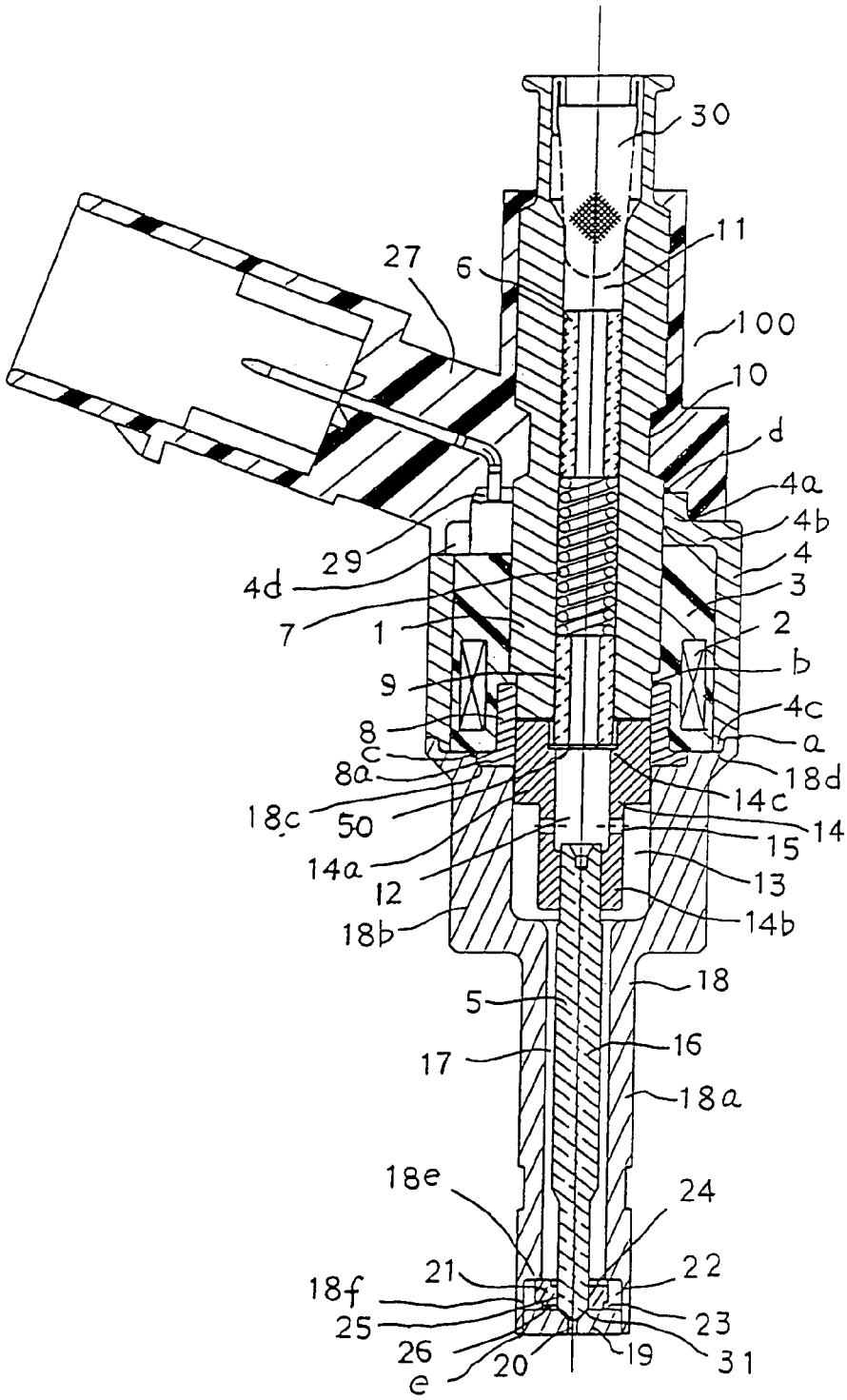
FIG. 1 is a vertical cross-sectional view showing a fuel injector in a preferred embodiment according to the present invention.

As shown in FIG. 1, a hollow fixed core 1, an electromagnetic coil 2 and a yoke 4 are arranged from the center toward the outer diameter in a fuel injector 100, and further, a needle 5 with a valve element is contained inside a nozzle body (also referred to as a nozzle holder) 18 fixed to the lower portion of the yoke 4, wherein the needle 5 is urged toward a valve seat 31 by the force of a return spring 7.

With respect to the basic movement of the fuel injector 100, when the electromagnetic coil 2 is energized, the yoke 4, the fixed core 1, a movable core 14, (i.e., a part of the needle 5) and the upper portion of the nozzle body 18 constitute a magnetic circuit, so that the needle 5 is attracted against the force of the return spring 7, thereby achieving a valve opening; in contrast, when the energization of the electromagnetic coil 2 is stopped, the needle 5 abuts against the valve seat 31 by the force of the return spring 7, thereby achieving a valve closing.

In the present embodiment, the lower end of the fixed core 1 functions as a stopper for receiving the needle 5 during the valve opening.

The fixed core 1 is formed into an elongated, hollow and slenderly cylindrical shape. The fixed core 1 and the nozzle body 18 are coupled to each other via a non-magnetic, cylindrical seal ring 8 extending over the outer circumference of one end on the nozzle body side of the fixed core 1 and the inner circumference of one end of the nozzle body 18.

The seal ring 8 is ground with material such as SUS316, and is formed into a cylinder having a flange 8*a* at one end thereof. One end of the cylinder on a side opposite to the flange 8*a* is press-fitted and welded to one end of the outer circumference of the fixed core 1; on the other hand, the flange 8*a* is press-fitted and welded to an annular step (an annular groove) 18*c* formed at the inner edge of the upper end of the nozzle body 18. Such welding is performed over the entire coupling boundary of, for example, portions designated by reference characters (b) and (c) by laser welding in order to keep sealability.

Here, the annular step 18*c* is a part having the greatest inner diameter of the stepped inner circumference of the nozzle body 18.

An upper portion 18*b* of the nozzle body 18 has greatest inner and outer-diameters in the nozzle body 1 in order to house therein the movable core 14*a*, described later, in such a manner as to allow a freely reciprocating movement (a stroke movement required for opening or closing a valve). A slender, long nozzle portion 18*a* extends from the lower portion.

Figure 2:
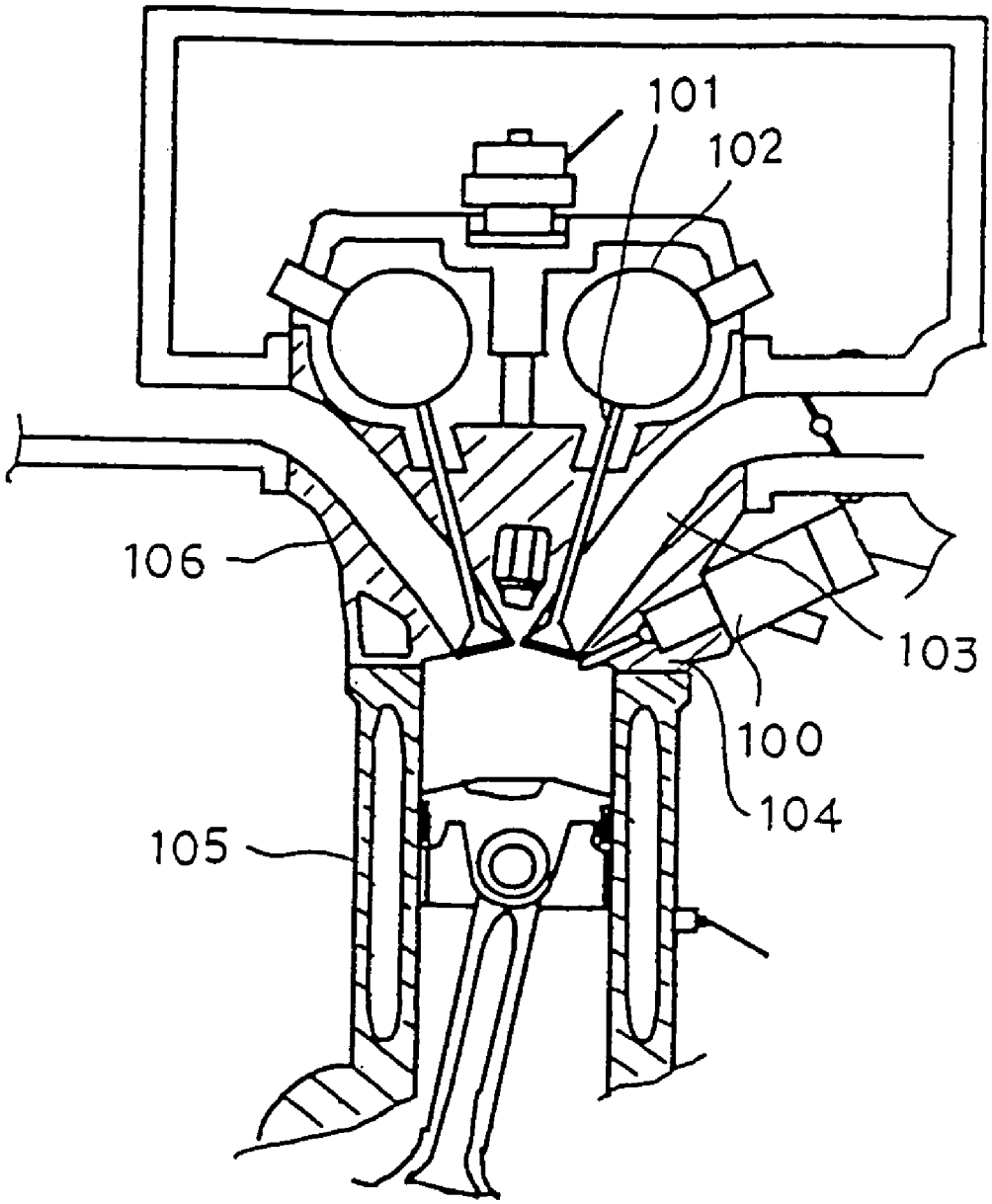
FIG. 2 illustrates the mounted state of the fuel injector.

In an injection system in which the fuel injector 100 is mounted directly in a cylinder head 106 of an engine 105, as shown in FIG. 2, the long nozzle portion 18*a* enables an injector body having a large diameter to be placed at a position apart from (i.e., a position without any interference with) a suction valve 101, a drive mechanism 102 for a suction/exhaust valve, a intake manifold 103 or the cylinder head 106 in the case where the suction valve 101, the drive mechanism 102, the intake manifold 103 and the like are mounted at a high density, with an attendant advantage of the higher degree of fixing freedom.

The upper portion (the large-diameter portion) 18*b* of the nozzle body 18 extends upward to a position at which a magnetic flux for attracting the movable core is allowed to pass when the electromagnetic coil 2 is energized, that is, to a position at which a part of the magnetic circuit is constituted. In view of this, the upper portion 18*b* of the nozzle body 18 also serves as a part of the yoke 4.

The upper end-surface of the nozzle body 18 includes the above-described annular step 18*c* for allowing the flange 8*a* of the seal ring 8 to be press-fitted thereto while a step 18*d* to be press-fitted in a spigot joint manner to (i.e., in uneven engagement with) the yoke 4, and therefore, includes three stepped surfaces in total.

In the yoke 4, an opening at the lower end (i.e., one end facing the nozzle body 18) is formed slightly larger than the outer diameter of the electromagnetic coil 2 with a resin mold 3, and thus, is formed into a so-called drop-bottomed shape. At the lower end of the yoke is formed a step 4*c* to be press-fitted to the step 18*d* of the nozzle body 18 in the spigot joint manner.

In the yoke 4, an upper wall 4*b* (hereinafter referred to as a shoulder) is formed in such a manner as to cover the upper end of the resin mold 3 of the electromagnetic coil 2. At the center of the shoulder 4*b*, a core inserting hole 4*a* engageable with the outer circumference of the fixed core 1 is formed by drawing.

The yoke 4 configured as described above is disposed from above the fixed core 1. Furthermore, the yoke 4 is configured such that it can be press-fitted (coupled) to the annular step 18*d* of the nozzle body 18.*in* the spigot joint manner in such a manner as to cover the electromagnetic core 2 with the resin mold 3. At a part of the shoulder 4*b* of the yoke 4 is formed as a window 4*d*, through which a connector terminal 29 for the electromagnetic coil 3 can be inserted.

The electromagnetic coil 2 is received at the upper end surface of the nozzle body 18, and then, is pressed at the inner surface of the shoulder 4*b* of the yoke 4, to be thus fixed thereto.

The yoke 4 and the nozzle body 18 are annularly welded to each other at a jointed portion (a) of the press-fitted portion (i.e., the spigot-jointed portion) therebetween, and further, the yoke 4 and the fixed core 1 are welded to each other at a position (d), thereby keeping the sealability.

The fixed core 1, the yoke 4, the needle 5 and the nozzle body 18 are made of, for example, a stainless-based magnetic material (i.e., electromagnetic stainless) in order to constitute the magnetic circuit of the electromagnetic coil 2.

Its machining mode will be described later.

At the lower end (i.e., the tip) of the nozzle body 18 are disposed an orifice plate 19 and a fuel swirler (hereinafter simply referred to as a swirler) 21, wherein these component parts 18, 19 and 21 are formed of separate members.

The orifice plate 19 is formed by, for example, a stainless-based disk-like chip, and is provided at the center thereof with an injection orifice (an orifice) 20, upstream of which the valve seat 31 is formed. The orifice plate 19 is press-fitted to the inner circumference 18*f* of the lower end of the nozzle body 18.

In the meantime, the swirler 21 is loosely fitted to the inner circumference of the lower end of the nozzle body 18, and is made of a sintered alloy such as SUS416.

Figure 4A:
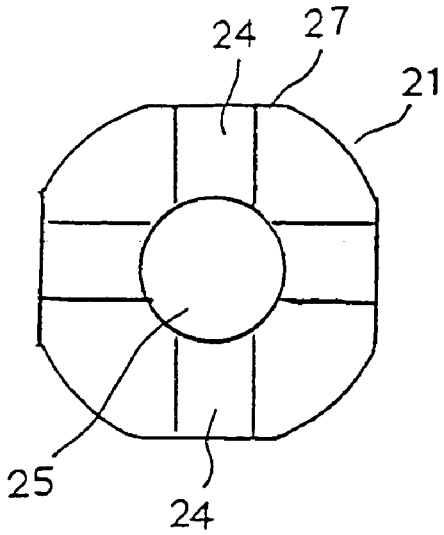
FIG. 4(*a*) is a top view showing a fuel swirler to be used in the present embodiment, FIG. 4(*b*) is a bottom view of the fuel swirler, and FIG. 4(*c*) is a vertical cross-sectional view of the fuel swirler.
Figure 4B:
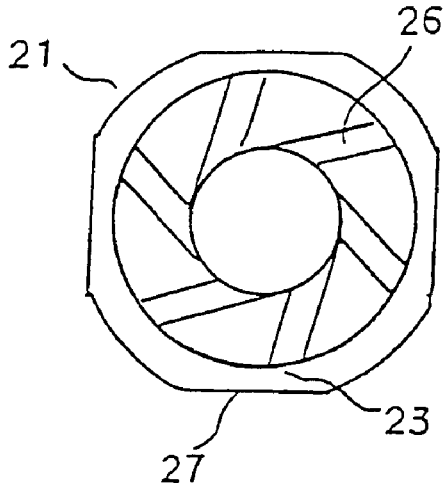
Figure 4C:
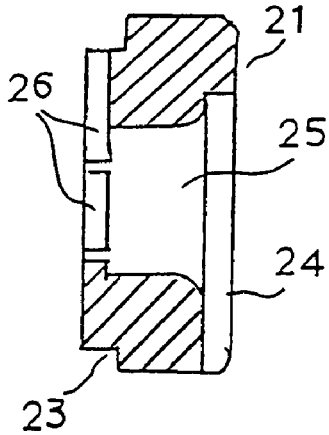

The swirler 21 is formed by a substantially disk-like chip, and is provided at the center thereof with a center hole (a guide) 25 for slidably guiding the tip (the valve element) of the needle 5 and at the upper surface thereof with a guide groove 24 for guiding fuel toward the outer circumference, as shown in FIGS. 4(*a*) and 4(*c*).

Moreover, as shown in FIGS. 4(*b*) and 4(*c*), an annular step (an annular passage) 23 is formed at the peripheral edge of the lower surface of the swirler 21, and further, a plurality of, for example, six passage grooves 26 for forming a fuel swirl are arranged between the annular passage 23 and the center hole 25. The passage groove 26 is formed in substantially the tangential direction from the outer diameter of the swirler 21 to the inner diameter thereof, so as to generate swirling force in the fuel injected from the passage groove 26 toward the lower end of the center hole 25.

The annular step 23 is formed because it need serve as a fuel sump. Moreover, a plurality of chamfers 27 are formed at the outer circumference of the swirler 21. The chamfers 27 are referred to in machining the grooves 24 and 26 and the like.

At the tip (one end on the fuel injection side) of the nozzle body 18 is formed the inner circumference (the stepped inner circumference) 18*f* with a receiving surface 18*e* for receiving the swirler 21 and the orifice plate 19. The swirler 21 is received at the receiving surface 18*e* of the nozzle body 18, to be loosely fitted to the inner circumference of the nozzle body. On the other hand, the orifice plate 19 is press-fitted and welded to the inner circumference in such a manner as to press the swirler 21.

The swirler 21 and the orifice plate 19 are disposed in the above-described manner, so that the swirler 21 can be held between the receiving surface 18*e* and the orifice plate 19, and further, an annular fuel passage 22 is defined between the outer circumference of the swirler 21 and the inner circumference of the tip of the nozzle body 18. The annular fuel passage 22 can be sufficiently secured as a fuel passage without any chamber 27. Via these annular fuel passages 22 and 23, the fuel can flow into the groove 26 for forming a swirl in the swirler 21.

The upper surface of the swirler 21 is configured such that the fuel guide groove 24 is formed for the purpose of the press-contact with the receiving surface 18*e* formed in the nozzle body 18, so that the fuel staying upstream of the swirler can flow into the annular fuel passage 22 around the swirler 21 via the groove 24. The groove 24 may be formed on a side of the receiving surface 18*e* of the nozzle body other than the upper end surface of the swirler 21.

That is, whichever the swirler 21 and the nozzle body 18 may be, it is sufficient that a passage groove for guiding the fuel around the swirler is defined between the upper end surface of the swirler and the receiving surface of the nozzle body receiving the former.

Incidentally, a part of the orifice plate 19 intrudes into the groove 26 formed at one end surface of the swirler 21 to such an extent that the part cannot interfere with the flow in the passage groove, and thus, secures the function of a detent of the swirler 21.

For example, if the hardness of the swirler 21 is made to be greater than that of the orifice plate 19, a part of the orifice plate 19 can bite the groove 26 when the orifice plate 19 is press-fitted, thereby securing the detent of the swirler 21 and preventing any misalignment of the swirler 21.

The needle 5 includes a valve rod (i.e., a needle) 16 and the hollow, cylindrical movable core 14 having an outer diameter greater than that of the valve rod 16. The valve rod 16 and the movable core 14 are constituted of separate members, and are integrally coupled to each other by press-fitting and welding the valve rod 16 to one end of the movable core 14.

A part of each of the movable core 14 and the valve rod 16 serves as a guide surface on a movable side. Here, one-part 14*a* at the outer peripheral surface of the movable core 14 is slidably guided on the inner circumference of the seal ring 8 during a stroke movement at the time of the valve opening or closing, and then, the peripheral surface near the tip of the valve rod 16 is slidably guided to the center hole 25 of the swirler 21, thereby constituting a so-called two-point support guide system.

In the present embodiment, the diameter of the outer circumference 14*a* of the upper portion of the movable core 14 is made to be greater than that of an outer circumference 14*b* of the lower portion thereof, so that the outer circumference 14*a* of the upper portion is slidably guided at the inner circumferential surface of the seal ring 8; in the meantime, the diameter of the outer circumference 14*b* of the lower portion is made to be smaller than that of the outer circumference 14*a* of the upper portion, so that a sufficient fuel passage 13 can be secured between the outer circumference 14*b* of the lower portion and the inner circumference of the nozzle body 18.

The fuel passage 13 and the inside of the movable core 14 serving as an upstream passage 12 communicate with each other via a plurality of through holes (i.e., orifices) 15 formed on a core wall of the outer circumference 14*b* of the lower portion.

A step 14*c* is formed at the inner surface of the upper portion of the movable core 14, and is provided with an annular plate spring (i.e., a damper plate) 50.

Figure 5A:
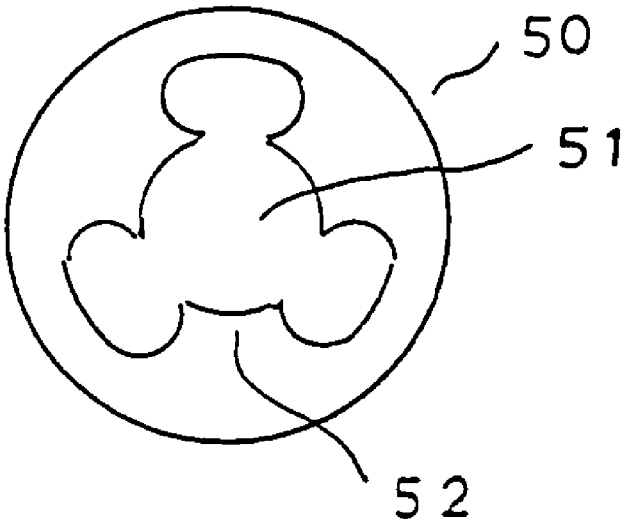
FIG. 5(*a*) is a plan view showing a damper plate (a plate spring) to be used in the present embodiment, and FIG. 5(*b*) is a cross-sectional view showing the damper plate.
Figure 5B:
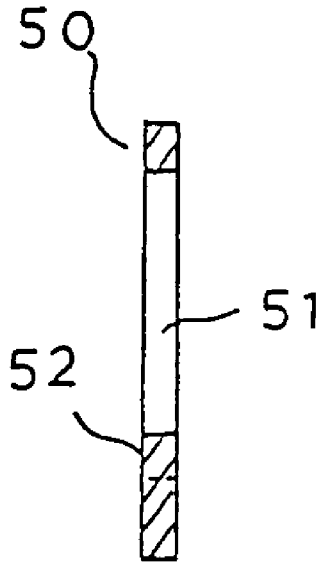

As shown in FIG. 5, the plate spring 50 is formed into an annular shape, and an inside portion designated by reference numeral 51 is punched. A plurality of elastic pieces 52 projecting inward are formed by punching in arrangement at equal intervals in the circumferential direction.

The elastic pieces 52 in the plate spring 50 receive one end of a cylindrical movable mass (i.e., a weight) 9, which is, for example, a carbon steel forging product.

The movable mass 9 is positioned over one end of the inner circumference of the fixed core 1 and one end of the inner circumference of the movable core 14. A hollow hole 11 of the fixed core 1 serves as a fuel passage. Inside the hollow hole 11 are contained the movable mass 9, the return spring 7 and a spring presser 6 in order from under. A filter 30 is disposed at the upper end of the hollow hole 11.

The spring presser 6 is fixed by caulking a peripheral portion 10 of the fixed core 1.

The movable mass 9 is interposed between the return spring 7 and the needle 5 (the movable core 14) in such a manner as to be freely moved in an axial direction independently of the needle 5. In order to ensure the independent movability, the spring plate 50 is interposed between the movable mass 9 and the needle 5, so that the elastic pieces 52 of the spring plate 50 receive the movable mass 9.

In this manner, the movable mass 9 fulfills a damper function of suppressing a bounce of the needle 5 during a valve closing movement owing to its independence of the needle 5 with a valve. This damper function produces a remarkably effective result, the principle of which is considered as follows: namely, it is considered that although the needle 5 is about to bounce when the needle 5 collides against the valve seat 31 by the force of the return spring 7 during the valve closing movement, the inertia of the movable mass 9 and the resilient deformation of the spring plate 50 absorb kinetic energy of the bounce at that time, thereby attenuating the bounce.

A connector mold (i.e., a resin mold) 27 is formed around a portion projecting from the yoke 4, of the fixed core 1.

Subsequently, a description will be given of the assembly and the machining mode of main component parts in the present embodiment.

Figure 3:
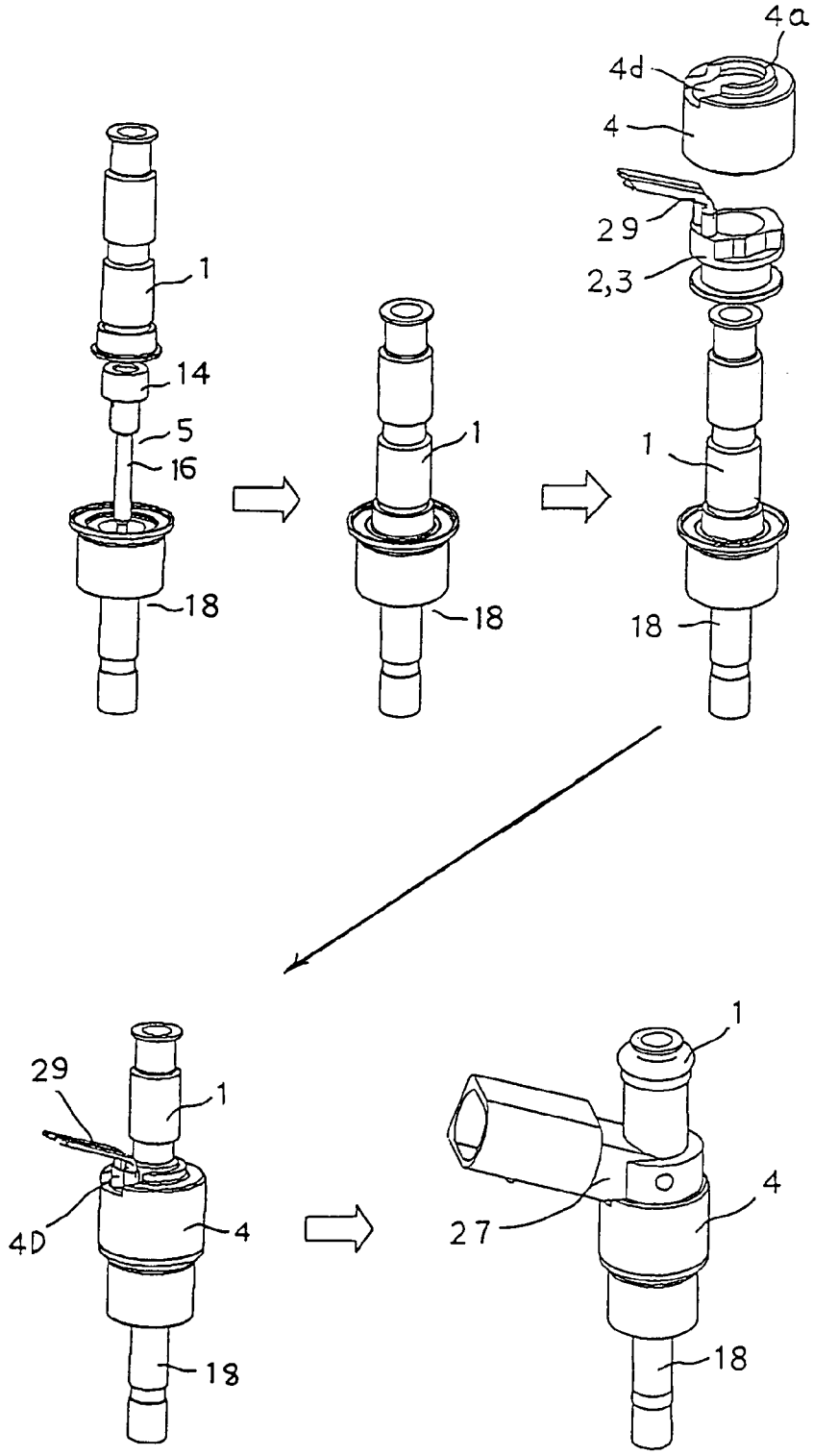
FIG. 3 illustrates the assembling process of the fuel injector.

As shown in FIG. 3, in assembling the fuel injector in the present embodiment, the component parts are inserted from above in reference to the nozzle body 18 except for resin molding with the connector mold.

Pre-processes before assembling the component parts will be explained below.

The yoke 4 is a pressed and cut product. The nozzle body 18 is a cold forged product through not cutting but lathing. The swirler 21 is a sintered product through cutting. The orifice plate 19 is lathed, and further, is quenched in order to enhance its hardness. The valve seat 31 and the orifice 20 are ground and end-lapped.

The valve rod 16 is quenched, and the movable core 14 is annealed. Thereafter, these component parts 14 and 16 are integrally coupled to each other by press-fitting and welding, thus constituting the needle 5.

The outer circumference of the needle 5 is ground. The outer peripheral surface (the movable guide surface) 14*a* at the upper portion and the end surface (the movable stopper surface) in the movable core 14 are subjected to hard plating.

The fixed core 1 is a cold forged product through lathing and annealing, and further, the tip thereof serving as a stopper surface with respect to the needle is subjected to hard plating. The seal ring 8 is lathed, and then, is press-fitted and welded to one end of the outer circumference of the fixed core 1 after plating.

The swirler 21 is loosely fitted to the nozzle body 18 by the use of a centering jig, and thereafter, the orifice plate 19 is press fitted and welded to the nozzle body 18.

The above pre-processed component parts are assembled in the following procedure.

The needle 5 having the plate spring 50 disposed therein is inserted into the nozzle body 18 from above, and then, the flange at one end of the seal ring 8 fixed to the fixed core 1 with the seal ring 8 is press-fitted and welded to the nozzle body 18, so that the fixed core 1 and the nozzle body 18 are integrally coupled to each other. Before the integral coupling, the step of the nozzle body 18 serving as the coupled (press-fitted) portion is measured, and further, the step of the flange of the seal ring 8 on the side of the fixed core 1 is measured. The fixed core 1 and the nozzle body 18 through the measurement examination are integrally coupled to each other. Consequently, the coaxial accuracy can be ensured.

Thereafter, the assembly of the electromagnetic coil 2 and the yoke 4 are fitted into the fixed core 1 from above. The yoke 4 is also coupled to the nozzle body 18 by press-fitting and welding. And then, the connector mold 27 is formed.

The above finished products constitute the magnetic circuit, described already, when the electromagnetic coil is energized (excited), so that the needle 5 is attracted until it abuts on one end of the fixed core 1 against the force of the return spring 7, thereby achieving the valve opening movement. At the time of the valve opening, pressurized fuel is injected with a swirl from the injection orifice 20 via the swirler 21 through the filter 30, the fuel passages 11 and 12, the orifices 15 and the passages 13 and 17.

The present embodiment can produce the following effects:

(1) When the electromagnetic coil 2 is de-energized, the needle 5 is moved in the closing direction by a load accumulated in the return spring 7, and then, abuts against the valve seat 31. At this time, the damper function of the movable mass 9 and the plate spring 50, as described already, suppresses the bounce of the valve element 16, thereby effectively preventing any secondary injection.

(2) Furthermore, since the entire outer circumference 14*a* of the upper portion of the movable core is slidably guided on the inner circumference of the seal ring 18 during the valve opening/closing movement, the fuel is hardly relieved to the slidably guiding surface, and consequently, all the fuel flows between the passage 12 inside of the movable core 14 and the passage 13 outside thereof via the orifices 15. Therefore, the liquid damper function is appropriately fulfilled between the lower end surface (the stopper) of the fixed core 1 and the end surface of the movable core 14, thus contributing to alleviation of an impact of the needle 5 with respect to the stopper and suppression of the bounce of the needle 5 at the time of the valve closing.

(3) The needle 5 is supported and guided at the two points on the inner circumference of the swirler 21 and the inner circumference of the seal ring 8. Consequently, the nozzle body per se need not be equipped with a guide function, unlike the prior art. Therefore, it becomes unnecessary to grind the nozzle body with high accuracy while the seal ring, which is easy to be lathed, can ensure the highly accurate guide function. Thus, the needle can be supported and guided at the two points at a reduced cost even in the case of a long nozzle injector.

(4) The prior art has experienced the problem that the coaxial accuracy is enhanced while eliminating a troublesome grinding work (the guide formation) with respect to the inner circumference of the nozzle body 18. However, through the above-described assembling process, the fixed core 1 and the nozzle body 18 can be integrally coupled to each other by press-fitting and welding the seal ring 18 with relative facilitation while the high coaxial accuracy is maintained, thereby streamlining the assembling work and reducing the cost.

(5) Moreover, as shown in FIG. 3, all of the component parts except the connector mold can be assembled in the same direction in reference to the nozzle body 18, thus contributing to the facilitation and automation of the work.

(6) Since the swirler 21 is loosely fitted while is fixed to the orifice plate 19, the swirler 21 can be prevented from being shifted, and further, the entire circumference of the swirler 21 constitutes the annular fuel passage, thereby reducing passage resistance, facilitating the relief of bubbles, which have been liable to remain at the lower end of the swirler 21, and achieving the smooth fuel injection.

(7) Although the swirler 21 is loosely fitted, it is free from physical restriction of other members until the centering jig is set in fitting, thereby offering the degree of centering freedom. Furthermore, even in the case where the orifice plate 19 is welded, thermal expansion caused by the resultant welding heat also is absorbed at the clearance defined around the swirler 21, thus preventing any generation of thermal deformation in the swirler 21.

(8) The annular passage 23 defined by the annular step is formed upstream of the groove 24 for forming the fuel swirl at the lower end surface of the swirler 21, and thus, functions as the fuel sump. Consequently, it is possible to enhance the injection responsiveness at the time of the fuel injection.

INDUSTRIAL APPLICABILITY

As described above, the present invention can solve the problems so as to reduce the cost of the fuel injector, enhance the centering accuracy (the coaxial accuracy), facilitate the assembling work, simplify the component parts, offer the degree of fixing freedom, prevent any secondary injection and the like.

What is claimed is:

1. An electromagnetic fuel injector, in which a hollow fixed core, an electromagnetic coil and a yoke are arranged from the center toward the outer diameter, a needle with a valve element is contained in a nozzle body fixed to the lower portion of the yoke, and the needle is urged toward a valve seat by the force of a return spring, the electromagnetic fuel injector characterized in that:

a fuel swirler positioned upstream of an injection orifice is disposed at the tip of the nozzle body, the fixed core and the nozzle body being coupled to each other through a non-magnetic cylindrical seal ring press-fitted and welded to the outer circumference of one end on the nozzle body side of the fixed core and the inner circumference of one end of the nozzle body; and the inner circumference of the fuel swirler and the inner circumference of the seal ring function as a guide for slidably guiding a stroke movement of the needle.

2. An electromagnetic fuel injector according to claim 1, characterized in that the yoke and the nozzle body also are coupled to each other by press-fitting and welding.

3. An electromagnetic fuel injector according to claim 2, characterized in that the seal ring has a flange at one end thereof, one end of a cylindrical portion on a side opposite to the flange is press-fitted and welded to one end of the outer circumference of the fixed core, while the flange is press-fitted and welded to an annular step formed at the upper end of the nozzle body; and the yoke and the nozzle body are press-fitted in a spigot joint manner, followed by welding.

4. An electromagnetic fuel injector, in which an electromagnetic coil and a yoke are arranged around a hollow cylindrical fixed core, a nozzle body containing therein a needle with a valve element is fixed to the lower portion of the yoke, and the needle is urged toward a valve seat by the force of a return spring, the electromagnetic fuel injector characterized in that:

the fixed core and the nozzle body comprise an assembly by being united through a non-magnetic cylindrical seal ring;

the electromagnetic coil and the yoke are arranged to be passed over the top of the fixed core and positioned around the fixed core;

the yoke is coupled to the upper end of the nozzle body in such a manner as to cover the top of the electromagnetic coil;

a terminal taking-out window for the electromagnetic coil is formed at a part of the upper portion of the yoke; and the inner surface of the upper end of the yoke presses the electromagnetic coil, thereby the coil is fixed between the outer surface of the assembly and the inner surface of the yoke.

5. An electromagnetic fuel injector according to claim 4, characterized in that an inner circumference of the upper end of a bore of the yoke through which the fixed core passes is coupled to the outer circumference of the fixed core by any of welding, press-fitting and caulking.

6. An electromagnetic fuel injector, in which an electromagnetic coil and a yoke are arranged around a fixed core, a nozzle body containing therein a needle with a valve element is fixed to the lower portion of the yoke, and the needle is urged toward a valve seat by the force of a return spring, the electromagnetic fuel injector characterized in that:

the fixed core and the nozzle body are coupled to each other through a non-magnetic cylindrical seal ring extending over the outer circumference of one end of the fixed core and the inner circumference of one end of the nozzle body;

the inner circumference of the seal ring serves as a guide for the needle;

the needle has a hollow, cylindrical movable core, the outer circumference of the upper portion of the movable core being slidably guided on the inner circumference of the seal ring during a stroke movement, a fuel passage being secured between the outer circumference of the lower portion and the inner circumference of the nozzle body, and the fuel passage communicating with another fuel passage defined inside of the movable core via a through hole formed at the movable core.

7. An electromagnetic fuel injector according to claim 6, characterized in that the outer circumference of the lower portion of the movable core is made to be smaller in diameter than the outer circumference of the upper portion thereof so as to enlarge the fuel passage defined between the outer circumference of the lower portion and the inner circumference of the nozzle body, the through hole being formed on a core wall on which the outer circumference of the lower portion is positioned.

8. An electromagnetic fuel injector characterized in that:

a nozzle body, an orifice plate having an injection orifice and a fuel swirler are formed of separate members;

an inner circumference having a receiving surface for disposing the fuel swirler and the orifice plate is formed at one end on a fuel injection side of the nozzle body;

the fuel swirler is is put in the inner circumference of the nozzle body with a clearance in such a manner as to be received at the receiving surface of the nozzle body; and the orifice plate is fitted and welded to the inner circumference in such a manner as to press the fuel swirler on the receiving surface, thereby the fuel swirler and the orifice plate are set into one end of the nozzle body in order of the fuel swirler, followed by the orifice plate.

9. An electromagnetic fuel injector characterized in that:

a nozzle body, an orifice plate having an injection orifice and a fuel swirler are formed of separate members;

an inner circumference having a receiving surface for disposing the fuel swirler and the orifice plate is formed at one end of a fuel injection side of the nozzle body;

the fuel swirler and the orifice plate are set into one end of the nozzle body in order of the fuel swirler, followed by the orifice plate; and the fuel swirler is held by the receiving surface of the nozzle body and the orifice plate, thereby an annular fuel passage is formed between the outer circumference of the fuel swirler and the inner circumference of the nozzle body, so that fuel flows into a passage groove formed at the lower end surface of the fuel swirler via the annular fuel passage.

10. An electromagnetic fuel injector characterized in that:

a nozzle body, an orifice plate having an injection orifice and a fuel swirler are formed of separate members, an inner circumference having a receiving surface for disposing the fuel swirler and the orifice plate is formed at one end on a fuel injection side of the nozzle body, the fuel swirler is loosely fitted to the inner circumference of the nozzle body in such a manner as to be received at the receiving surface of the nozzle body, the orifice plate is press-fitted and welded to the inner circumference in such a manner as to press the fuel swirler, and a guide groove for guiding the fuel to the outer circumference of the fuel swirler is formed between the upper end surface of the fuel swirler and the receiving surface of the nozzle body for receiving the upper end surface of the fuel swirler.

11. An electromagnetic fuel injector according to claim 10, characterized in that the guide groove is formed at the upper end surface of the fuel swirler and/or the receiving surface of the nozzle body.

12. An electromagnetic fuel injector characterized in that:

a nozzle body, an orifice plate having an injection orifice and a fuel swirler are formed of separate members, an inner circumference having a receiving surface for disposing the fuel swirler and the orifice plate is formed at one end on a fuel injection side of the nozzle body, the fuel swirler is loosely fitted to the inner circumference of the nozzle body in such a manner as to be received at the receiving surface of the nozzle body, the orifice plate is press-fitted and welded to the inner circumference in such a manner as to press the fuel swirler, and the hardness of the fuel swirler is greater than that of the orifice plate.

13. An electromagnetic fuel injector characterized in that:

a nozzle body, an orifice plate having an injection orifice and a fuel swirler are formed of separate members, an inner circumference having a receiving surface for disposing the fuel swirler and the orifice plate is formed at one end on a fuel injection side of the nozzle body, the fuel swirler is loosely fitted to the inner circumference of the nozzle body in such a manner as to be received at the receiving surface of the nozzle body, the orifice plate is press-fitted and welded to the inner circumference in such a manner as to press the fuel swirler, and a part of the orifice plate intrudes into the passage groove for generating a swirl, formed at the lower end surface of the fuel swirler.

14. An electromagnetic fuel injector in which a fuel swirler is disposed upstream of a fuel injection orifice, the electromagnetic fuel injector characterized in that:

the upper surface of the fuel swirler is equipped with fuel passage grooves for letting fuel flow from a center of the fuel swirler to an outer circumference thereof;

the lower surface of the fuel swirler is equipped with passage grooves for generating a swirl to fuel and an annular passage communicating with the passage grooves for swirl at an upstream side of the passage grooves;

the outer circumference of the fuel swirler is equipped with faces to be fuel passages for connecting the fuel passage grooves of the upper surface and the annular passage of the lower end surface.

15. An electromagnetic fuel injector according to claim 14, characterized in that the annular passage is defined by forming an annular step at the peripheral edge of one end surface of the fuel swirler.

16. An electromagnetic fuel injector, in which a hollow fixed core, an electromagnetic coil and a yoke are arranged from the center toward the outer diameter, a needle with a valve element is contained in a nozzle body fixed to the lower portion of the yoke, and the needle is urged toward a valve seat with application of the force of a return spring, the electromagnetic fuel injector characterized in that:

a mass movable in an axial direction independently of the needle is interposed between the return spring and the needle.

17. An electromagnetic fuel injector, in which a hollow fixed core, an electromagnetic coil and a yoke are arranged from the center toward the outer diameter, a needle having a valve element is contained in a nozzle body fixed to the lower portion of the yoke, and the needle is urged toward a valve seat by the force of a return spring, the electromagnetic fuel injector characterized in that:

a mass movable in an axial direction independently of the needle is interposed between the return spring and the needle, and a plate spring is interposed between the mass and the needle.

18. An electromagnetic fuel injector characterized in that:

a nozzle body, an orifice plate having an injection orifice and a fuel swirler are formed of separate members, an inner circumference having a receiving surface for disposing the fuel swirler and the orifice plate is formed at one end of a fuel injection side of the nozzle body, the fuel swirler is held between the receiving surface of the nozzle body and the orifice plate, thus defining an annular fuel passage between the outer circumference of the fuel swirler and the inner circumference of the nozzle body, so that fuel flows into a passage groove formed at the lower end surface of the fuel swirler via the annular fuel passage, and a guide groove for guiding the fuel to the outer circumference of the fuel swirler is formed between the upper end surface of the fuel swirler and the receiving surface of the nozzle body for receiving the upper end surface of the fuel swirler.

19. An electromagnetic fuel injector according to claim 18, characterized in that the guide groove is formed at the upper end surface of the fuel swirler and/or the receiving surface of the nozzle body.

* * * * *